United States Patent [19]

Suppinger et al.

[11] Patent Number: 4,706,382

[45] Date of Patent: Nov. 17, 1987

[54] ASSEMBLY FOR PACKAGING MICROCIRCUITS HAVING GOLD PLATED GROUNDING AND INSULATING LEADS, AND METHOD

[75] Inventors: Albert V. Suppinger, Easton; Charles W. Tinley, Cambridge, both of Md.

[73] Assignee: North American Philips Corporation, New York, N.Y.

[21] Appl. No.: 772,074

[22] Filed: Sep. 3, 1985

[51] Int. Cl.[4] ..... H01R 43/20

[52] U.S. Cl. ..... 29/879; 29/418; 29/884; 174/52 FP

[58] Field of Search ..... 357/70; 174/52 H, 52 FP, 174/50.6, 50.61; 29/418, 879, 884, 845; 339/278 C

[56] References Cited

U.S. PATENT DOCUMENTS

| | | | |
|---|---|---|---|
| 3,793,709 | 2/1974 | Baumann | 357/70 X |
| 4,128,697 | 12/1978 | Simpson | 174/50.61 |
| 4,331,253 | 5/1982 | Gordon et al. | 174/52 FP X |
| 4,412,093 | 10/1983 | Wildeboer | 174/52 FP |
| 4,453,033 | 6/1984 | Duff et al. | 174/50.6 |
| 4,465,742 | 8/1984 | Nagashima et al. | 339/278 C |

*Primary Examiner*—Arthur T. Grimley
*Assistant Examiner*—David A. Tone
*Attorney, Agent, or Firm*—John C. Fox

[57] ABSTRACT

A plated metal assembly used for packaging hybrid microcircuits features both insulated and grounding leads plated with successive layers of nickel and gold, the leads attached to a metal header which is plated only with nickel. A method for mass producing the assembly includes pre-plating the grounding leads, and brazing them to the header after the header and insulated leads have been assembled and plated.

8 Claims, 5 Drawing Figures

ASSEMBLY FOR PACKAGING MICROCIRCUITS HAVING GOLD PLATED GROUNDING AND INSULATING LEADS, AND METHOD

BACKGROUND OF THE INVENTION

This invention relates to microcircuit packages, and more particularly relates to a metal assembly for packaging hybrid microcircuits having only the grounding and insulated leads gold plated, and also relates to a method for producing such an assembly.

Packaging for hybrid microcircuits often includes a metal header for supporting the circuit, and a plurality of leads for external connection to the circuit. The leads typically are arranged in rows along opposite sides of the header to flank the circuit and have heads positioned at a height to be coplanar with the circuit substrate for easy access. The leads extend through the bottom wall of the header and are normally insulated from the metal header by a metal sealing glass such as a borosilicate. The leads and header typically have electroplated layers of nickel, and the leads have a further electroplated gold layer.

In some cases, it is preferable to also have gold plated grounding leads which may be electrically connected to the metal header. In mass production, however, it has been found difficult to gold plate these leads without also unnecessarily gold plating the metal header to which they are connected.

Plating the leads prior to their assembly in the header is not a practical alternative, due to the necessity for a preoxidized, plating-free metal surface to achieve an effective glass-to-metal seal.

Accordingly, it is an object of the invention to provide an assembly for packaging microcircuits comprising a metal header and metal leads extending from the header, at least some of the leads forming a glass-to-metal seal with the header, and all of the leads being gold plated.

It is a further object of the invention to provide a method suitable for mass producing such an assembly without gold plating the header and without interfering with the integrity of the glass-to-metal seals.

SUMMARY OF THE INVENTION

In accordance with the invention, there is provided an assembly for packaging microcircuits comprising a metal header and a plurality of metal leads extending through the header, the leads including at least one grounding lead attached to the header by an electrically conducting material such as a braze, and a plurality of leads attached to the header by an insulating material such as a sealing glass, the insulated leads providing external electrical connection to the packaged microcircuit. The header and the leads are electroplated with a nickel layer, and the leads have an additional electroplated layer of gold, to provide excellent electrical contact with pin sockets or other external connectors.

Also, in accordance with the invention, there is provided a method which is suitable for mass production of the above assembly, comprising the steps of:

(a) attaching a plurality of leads to the wall of the header with an electrically insulating material to insulate the attached leads from the header;

(b) electroplating a layer of nickel onto the assembled header and insulated leads;

(c) electroplating a layer of gold onto the electroplated nickel layer on the insulated leads;

(d) successively electroplating layers of nickel and gold onto the lead to be grounded; and (e) attaching the lead to be grounded to the wall of the header.

In accordance with a preferred embodiment of the method, prior to electroplating the assembled header and insulated leads, a tie bar is attached to the leads near the ends of the leads, and the lead to be grounded is subsequently attached to the header by:

(a) positioning the lead to be grounded relative to the insulating leads;

(b) attaching the lead to be grounded to the tie bar;

(c) attaching the lead to be grounded to the header; and (d) cutting the assembled leads near their ends to a uniform length above the tie bar, thereby removing the tie bar from the assembly.

DESCRIPTION OF THE PREFERRED EMBODIMENTS

Figure 1:
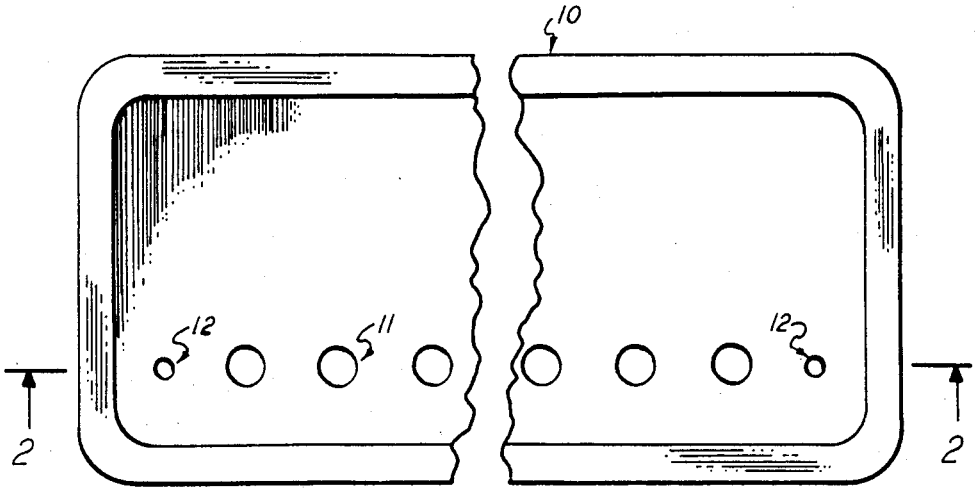
FIG. 1 is a plan view of a header used in the packaging of microcircuits.

Referring now to FIG. 1, there is shown a plan view of a typical cup-shaped metal header 10 used in the packaging of hybrid microcircuits. Apertures 11 and 12 are formed in rows along opposite sides of the bottom wall of the header. The larger apertures 11 are intended to accommodate electrical leads to be insulated from the header, while smaller apertures 12 are intended to accommodate other similar sized, grounding leads, to be electrically connected to the header.

Figure 2:
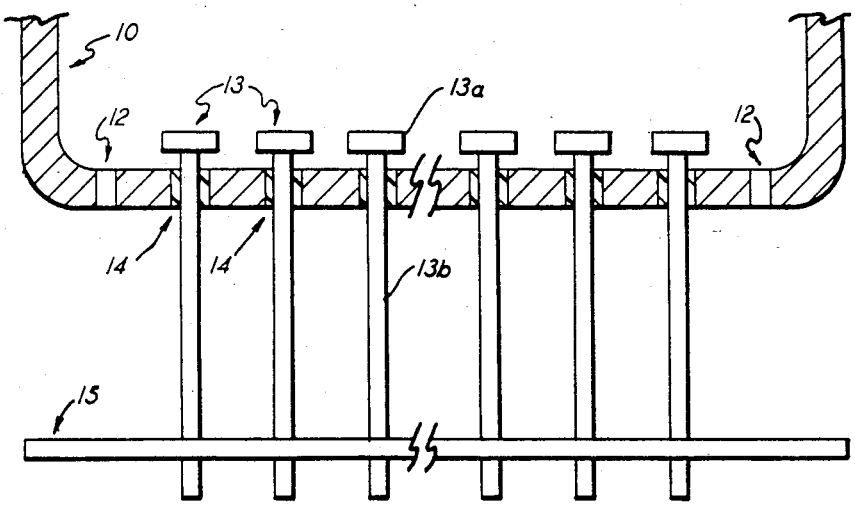
FIG. 2 is a section view of the header of FIG. 1, taken along the section line 2—2.

FIG. 2, a section view along line 2—2 of FIG. 1, shows a plurality of electrical leads 13, each having a head 13*a* and a shank 13*b*. extending through apertures 11, and positioned so that the tops of the heads 13*a* are approximately coplanar with the top of the substrate of the microcircuit. This allows ready access between various components of the microcircuit and the adjacent leads.

Positioned in the apertures 11 between the aperture walls and the leads are cylindrically-shaped apertured preforms 14 of a metal sealing glass composition such as a borosilicate. As is well known in the glass-to-metal sealing art, in order to form a reliable seal, the thermal expansion characteristics of the glass and metal must be similar to one another, and the metal surface must be clean, free of plated layers of other metals and preoxidized. As is also well known, an iron, nickel, cobalt alloy such as Kovar or Rodar (Kovar and Rodar are trademarks of Carpenter Technology) exhibits expansion characteristics suitable for sealing to a borosilicate glass. By way of example, a borosilicate glass having a thermal expansion of about $46\times10^{-7}$ *inches/inch/° C. from* 0° to 300° C. has been found to form an adequate glass-to-metal seal to Kovar headers and leads. Kovar has the approximate composition in weight percent: 29 percent nickel, 17 percent cobalt, remainder iron.

After the glass preforms have been inserted as shown, the seal is formed simply by heating the assembly to a temperature above the melting point of the glass, typically about 950° C. to 1000° C. Such a seal is illustrated in FIG. 3, in which the outer surfaces of glass 14 are curved to indicate that the glass preform has melted and wetted the surfaces of the aperture wall 11 and the lead 13.

Figure 3:
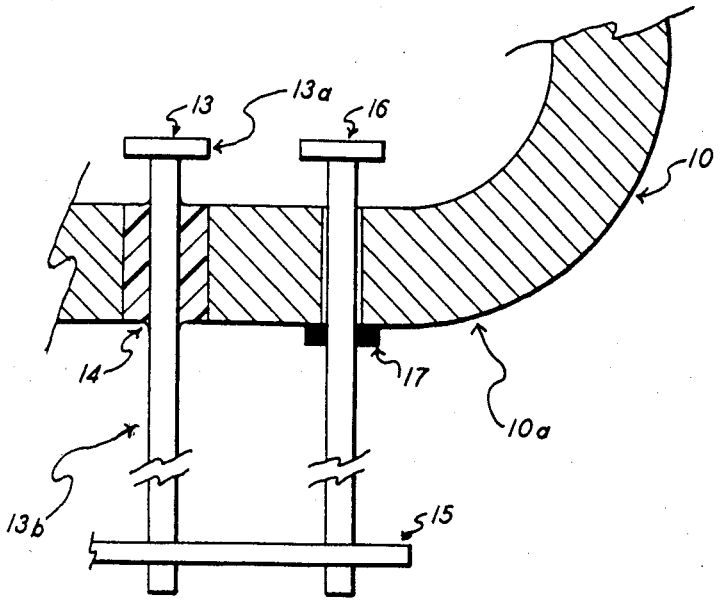
FIG. 3 is an enlarged portion of the section view of FIG. 2, showing both insulated and grounding leads.
Figure 4:
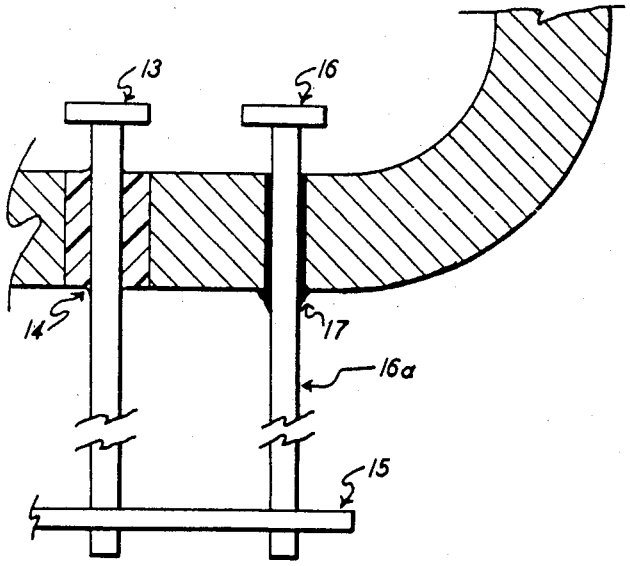
FIG. 4 is a section view similar to that of FIG. 3, showing the leads attacted to the header.

FIG. 3 also shows a lead 16 to be grounded to header 10 positioned in aperture 12, and washer-shaped braze preform 17 surrounding lead 16 and contacting the lower surface of header wall 10*a*. While the insulated leads must be free of any plating prior to sealing, the grounding leads may be pre-plated and a braze composition chosen to be compatible with the plated layers. The braze must also have a melting point below that of the sealing glass, so that the glass seals will not be disturbed by the brazing operation. A suitable low temperature braze for the gold plated leads of this invention is an 80/20 gold/tin braze (80 weight percent gold, 20 weight percent tin), melting at about 280° C. Brazing is carried out by heating the assembly above this temperature, but preferably below the softening point of the glass (710° C. for the borosilicate glass mentioned above). Preferably, brazing is carried out at a temperature within the range of about 300° C. to 650° C. Upon heating, the braze melts and wets the aperture wall and the adjacent portions of the shank 16*a* of the lead, as shown in FIG. 4. In order to prevent undesirable oxidation of the metals during brazing, the operation is carried out in a reducing atmosphere, for example, forming gas, a mixture of hydrogen and nitrogen. A tie bar 15, typically a metal strip resistance welded to the leads near their ends, provides electrical continuity to the sealed leads during plating. Furthermore, the tie bar serves a fixturing function in those applications where accurate alignment (±0.003 to ±0.005 inches) of the grounding lead heads with the insulated lead heads inside the header is required. Thus, the grounding leads may be accurately aligned, welded to the tie bar, and then brazed into the header. Subsequently, the tie bar is removed by microshearing the pins to a uniform length just above the tie bar.

Figure 5:
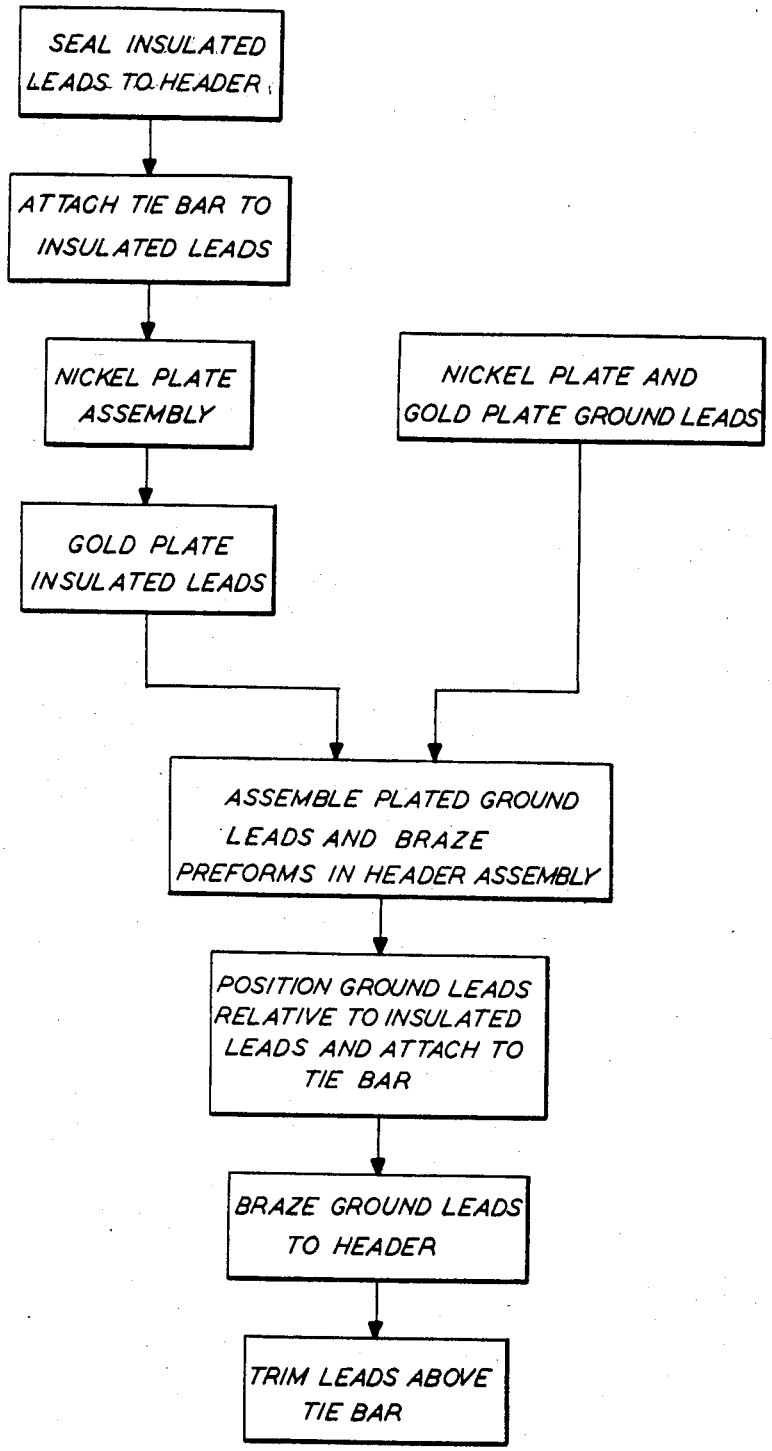
FIG. 5 is a block flow diagram illustrating one embodiment of the method of the invention.

FIG. 5 is a block flow diagram illustrating a preferred method of mass producing the header/lead assemblies of the invention. The leads to be insulated are first sealed into the header, in the manner described above. Next, the tie bar is attached to the sealed leads, and the assembly is nickel plated in a bath such as a sulfamate bath designated QQ-N-290A, published in Federal Specification Nickel Plating (Electrodeposited). Next, the leads only are plated in a gold bath such as MIL-G-45204B, published in Military Specification Gold Plating, Electrodeposited. The plating thicknesses typically range from about 50 to 250 microinches for the nickel, and from about 50 to 225 microinches for the gold.

The leads to be grounded are nickel and gold plated separately, in the same manner, to approximately the same thicknesses. These leads are then assembled into the header with the braze preforms, aligned with the insulated leads, welded to the tie bar and brazed in place. The leads are then trimmed to a uniform length to remove the tie bar.

What is claimed is:

1. A method for producing a metal assembly for packaging microcircuits, the assembly comprising a header and a plurality of leads extending through a wall of the header, including at least one grounding lead attached to the header by an electrically conductive material, and a plurality of insulated leads attached to the header by an electrically insulating material, the method comprising the steps of:

(a) attaching a plurality of leads to the wall of the header with an electrically insulating material to insulate the attached leads from the header;

(b) electroplating a layer of nickel onto the assembled header and insulated leads;

(c) electroplating a layer of gold onto the electroplated nickel layer on the insulated leads;

(d) successively electroplating layers of nickel and gold onto the lead to be grounded; and (e) thereafter attaching the electroplated lead to be grounded to the wall of the header.

2. The method of claim 1 in which prior to electroplating the nickel layer onto the assembled header and insulated leads, a tie bar is attached to the leads near the ends of the leads.

3. The method of claim 2 in which the lead to be grounded is attached to the header by:

(a) positioning the lead to be grounded relative to the insulated leads;

(b) attaching the lead to be grounded to the tie bar;

(c) attaching the lead to be grounded to the header; and (d) cutting the assembled leads near their ends to a uniform length above the tie bar, thereby removing the tie bar.

4. The method of claim 1 in which the header and leads consist essentially of a glass sealing alloy, the leads to be insulated are attached to the header by a metal sealing glass, and the lead to be grounded is attached to the assembled header and insulating leads by a low temperature brazing alloy having a melting point below the softening point of the glass.

5. The method of claim 4 in which the leads to be insulated are sealed to the header wall by inserting them through apertures in the header wall, inserting glass preforms into the apertures between the wall and the leads, and heating the assembled header, leads and preform to a temperature sufficient to melt the glass and form a glass-to-metal seal.

6. The method of claim 5 in which the glass sealing alloy composition consists essentially of in weight percent: 54 percent iron, 29 percent nickel and 17 percent cobalt, the metal sealing glass is borosilicate, and the leads are sealed at a temperature of about 950° C. to 1000° C.

7. The method of claim 4 in which the lead to be grounded is sealed to the header wall by inserting the lead through an aperture in the header wall, positioning the lead relative to the insulated leads, positioning a braze preform to contact the header wall and portion of the lead adjacent the aperture, and heating the assembled header leads and preform to a temperature sufficient to melt the preform and form a brazed joint, but insufficient to melt the glass seal.

8. The method of claim 7 in which the glass sealing alloy composition consists essentially of in weight percent: 54 percent iron, 29 percent nickel and 17 percent cobalt, the brazing alloy composition consists essentially of in weight percent:80 percent gold, 20 percent tin, and the leads are brazed at a temperature of about 300° C. to 650° C.

* * * * *